US008033235B2

(12) United States Patent
Harris

(10) Patent No.: US 8,033,235 B2
(45) Date of Patent: Oct. 11, 2011

(54) WATER CRAFT

(76) Inventor: Robin Jac Harris, Anglesey (GB)

( * ) Notice: Subject to any disclaimer, the term of this patent is extended or adjusted under 35 U.S.C. 154(b) by 187 days.

(21) Appl. No.: 11/720,626

(22) PCT Filed: Dec. 2, 2005

(86) PCT No.: PCT/GB2005/004645

§ 371 (c)(1),
(2), (4) Date: Nov. 16, 2007

(87) PCT Pub. No.: WO2006/059135

PCT Pub. Date: Jun. 8, 2006

(65) Prior Publication Data

US 2009/0277370 A1 Nov. 12, 2009

(30) Foreign Application Priority Data

Dec. 2, 2004 (GB) ..... 0426437.0
Apr. 4, 2005 (GB) ..... 0506794.7

(51) Int. Cl.
*B63G 8/22* (2006.01)

(52) U.S. Cl. ..... 114/333; 114/331

(58) Field of Classification Search ..... 114/312, 114/315, 330, 331, 332, 333, 338
See application file for complete search history.

(56) References Cited

U.S. PATENT DOCUMENTS

| | | | | |
|---|---|---|---|---|
| 3,257,982 A | | 6/1966 | Meldrum | |
| 3,943,869 A | * | 3/1976 | Frechette | 114/330 |
| 4,577,583 A | | 3/1986 | Green, II | |
| 5,704,309 A | * | 1/1998 | Kohnen | 114/312 |
| 6,065,419 A | * | 5/2000 | Stecker, Sr. | 114/315 |
| 6,321,676 B1 | | 11/2001 | Kohnen et al. | |
| 6,443,087 B1 | | 9/2002 | Stecker, Sr. | |

FOREIGN PATENT DOCUMENTS

| | | |
|---|---|---|
| FR | 2688466 | 9/1993 |
| GB | 2222390 | 3/1990 |
| GB | 2338943 | 1/2000 |
| WO | 97/20732 | 6/1997 |

* cited by examiner

*Primary Examiner* — Lars A Olson
(74) *Attorney, Agent, or Firm* — Gifford, Krass, Sprinkle, Anderson & Citkowski, P.C.

(57) ABSTRACT

A water craft (10) includes a hull (12) defining two cavities (18). An inflatable chamber (22) is arranged in each cavity (18), for displacing water from hull (12), in use, to increase the buoyancy of the craft (10). As the chamber (22) is inflated, it expands to reduce the free space available for water in the cavity (18), so as to directly expel water from the cavity (18). The chamber (22) can be deflated, in order to flood the cavity and thereby sink the craft (10). The craft (10) is intended to be operated in a normal buoyant mode and in a submarine mode, and includes propeller means (34). The craft may be in the form of a catamaran-type vessel, a jet-ski, or a submersible tank.

18 Claims, 3 Drawing Sheets

WATER CRAFT

The present invention relates to a submersible water craft.

Various forms of water craft are known, typically for transporting passengers or cargo across water. However, some forms of water craft are intended to be submersible, for transportation at least substantially below the surface of a body of water.

A submersible or 'underwater' craft is described in U.S. Pat. No. 6,321,676. The craft includes at least one sealed passenger chamber mounted on a frame. The sealed chamber and other aspects of the frame provide positive buoyancy for the craft.

The craft is intended to be static in its normal buoyant state at the water surface. A pair of elongate chambers are mounted below the frame, the chambers providing additional buoyancy, so as to stabilise the vehicle at the water surface, for example when loading or unloading passengers. These chambers include a bladder which can be inflated to increase the overall positive buoyancy of the craft.

A thruster system is mounted on the frame for countering the positive buoyancy of the craft, thereby enabling the craft to submerge. To raise the craft from a submerged state, the downward thrust is reduced to a level that is insufficient to counter said positive buoyancy.

The use of in inherently 'buoyant' craft significantly restricts the manoeuvrability of the craft underwater. Also, the integrity of the craft underwater, in particular in providing a water tight environment inside the sealed chambers, is difficult to maintain and requires careful assembly and regular checks. Furthermore, the overall structure of the craft is not readily suited to powered movement at water level.

A further underwater craft is described in WO 97/20732, again having a sealed passenger chamber and a pair of buoyancy chambers for providing stability to the craft.

Similarly, a thruster system is used to overcome the positive buoyancy of the craft, for lowering the craft in the water.

As such, the craft suffers from the same kind of disadvantages described above.

Clearly, there is a need for a water craft which addresses one or more of the problems of the known submersible water crafts referred to above.

According to an aspect of the invention, there is provided a water craft comprising a body defining a cavity, and an inflatable chamber provided in said cavity, wherein the chamber is arranged for displacing water from the cavity for increasing the buoyancy of the craft.

A plurality of chambers may be provided in the cavity, and a plurality of cavities may be provided in the craft. Preferably, a portion of each cavity is continually open for allowing water to enter said cavity, in use. For example, the cavity may be substantially tubular and define an open end. Each cavity may include a wall having drainage openings, and may form an open channel for the chamber(s) substantially along the length of the cavity.

The craft preferably includes means for determining the pressure within each chamber and may include means for selectively deflating each chamber in a controlled manner.

In a preferred embodiment, the body defines a pair of opposing cavities and a platform arranged therebetween. Preferably, the cavities are substantially G-shaped in cross-section. However, other shaped cavities may also be used, such as cavities having a C-shaped, V-shaped, or U-shaped cross-section.

Preferably, there is provided means for propelling the craft along a water surface, for example a jet-type device. Hence, the craft is preferably configured for planing along a water surface at speed, for example in the manner of a jet-ski or speed boat.

Other features and aspects of the invention will be readily apparent from the following description and drawings of preferred embodiments, provided by way of example only, in which.

Figure 1:
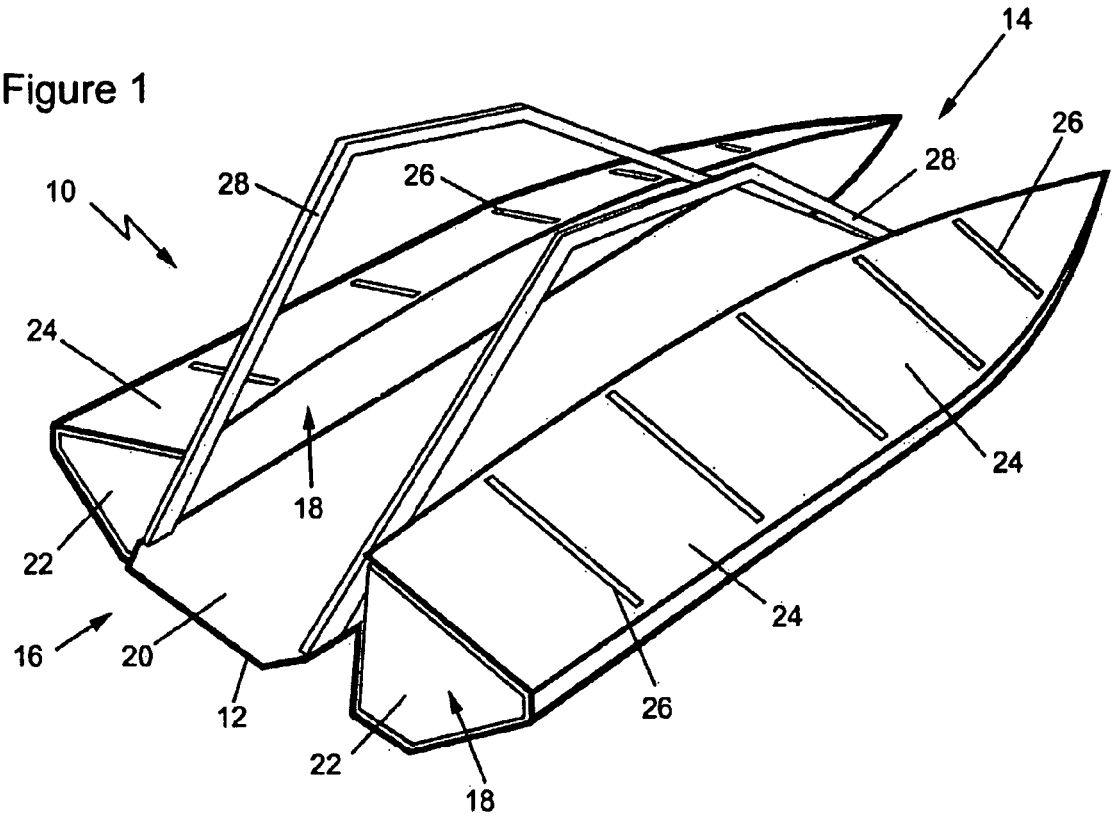
FIG. 1 is a schematic perspective view of a water craft in accordance with a preferred embodiment of the invention.
Figure 2:
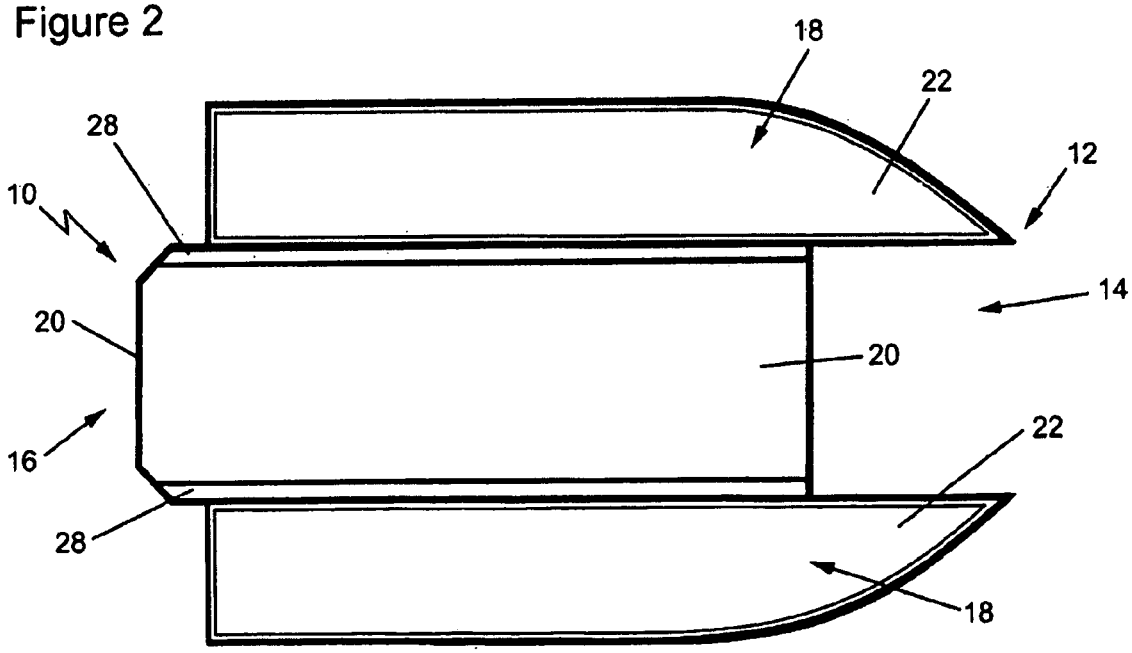
FIG. 2 is a schematic plan view of the water craft shown in FIG. 1.
Figure 3:
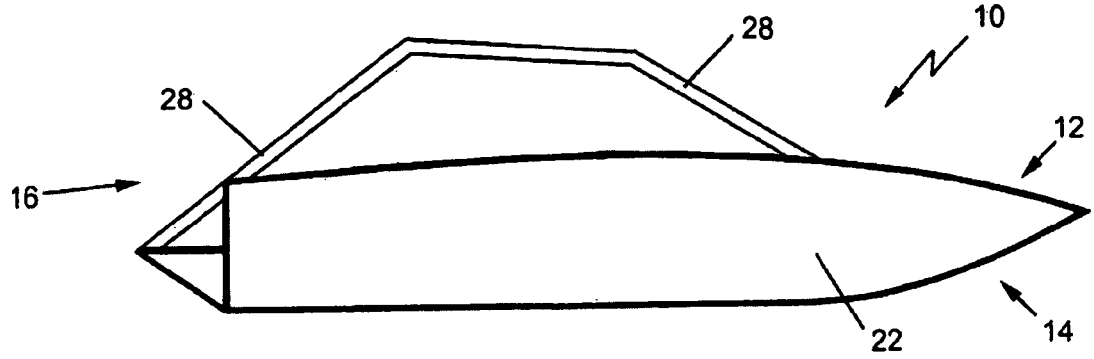
FIG. 3 is a schematic side view of the water craft shown in FIGS. 1 and 2.
Figure 4:
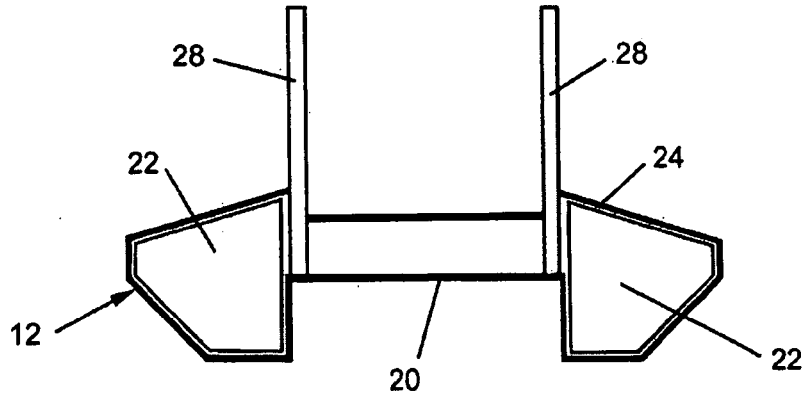
FIG. 4 is a schematic view from the rear of the water craft shown in FIGS. 1 to 3.

Referring firstly to FIGS. 1 to 4, a water craft is indicated generally at 10, which includes a stream lined hull 12 having a front end 14 and a rear end 16. The shape of the hull 12 is specifically configured for enabling the craft 10 to plane along a water surface at speed, for example in the manner of a jet-ski or speed boat.

The rear end 16 of the hull 12 is open, that is to say that the hull 12 does not have a rear wall or transom. This means that, in use, water is able to enter the hull 12 via the rear end 16, effectively to flood the hull and sink the craft, if desired, as will be described in more detail below.

The hull 12 defines a pair of parallel and substantially tubular cavities 18 spaced apart from one another by a centrally arranged platform 20. In this embodiment, the cavities 18 are substantially G shaped and are open at their rear end and axially along the length of the hull 12 in the region adjacent the platform 20. As can be seen, the walls of the cavities 18 form part of the hull structure.

The upper wall 24 of each cavity 18 includes parallel and spaced slot-like openings 26 extending generally in the transverse axis of the hull 12.

The central platform 20 provides a space between the two cavities. In this embodiment, the platform 20 is configured for receiving a user, substantially in the manner of a jet-ski, wherein the user is intended to stand or sit on the platform 20. Although not illustrated, control means for powered operation and steering of the craft 10 is mounted on the platform 20 towards its front end. Also, a jet propulsion device (not illustrated) is mounted beneath the platform 20, centrally relative to the two cavities 18, for propelling the craft along the water surface, when the craft is in a buoyant state.

A pair of frame members 28 are arranged on either side of the platform 20, extending upwardly therefrom. The frame members 28 add structural rigidity to the water craft 10 and offer a degree of protection to the user of the craft 10 in the manner of conventional roll bars for cars and the like.

In this embodiment, a single inflatable chamber 22 is mounted in each cavity 18. The water craft 10 includes a source of compressed air and control valve arrangement (not illustrated) for determining the pressure within the chambers and for selectively inflating or deflating the chambers 22, as required. This is preferably mounted on the platform 20 and forms part of the control means for the powered operation and steering of the craft 10.

Figure 5:
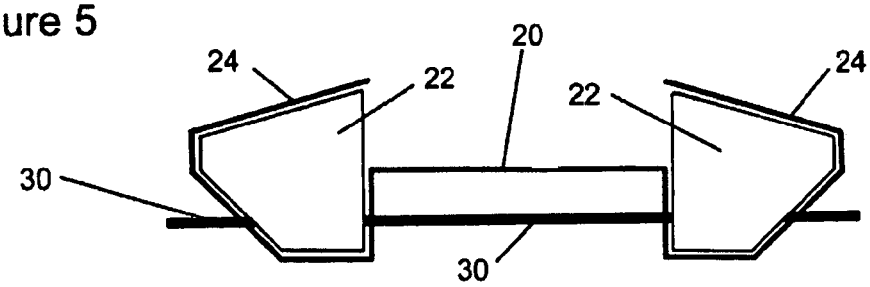
FIG. 5 is a view similar to FIG. 4, showing the water in a first operative condition.
Figure 6:
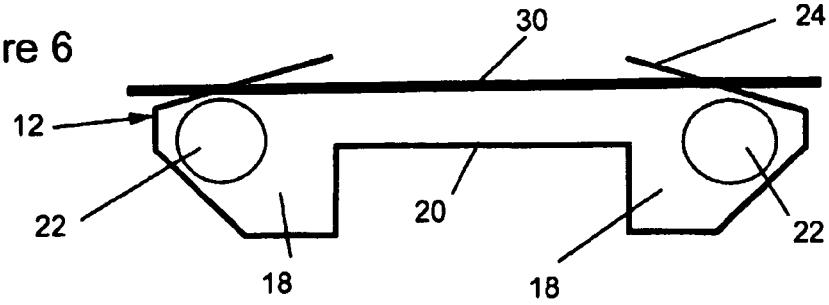
FIG. 6 is a view similar to FIG. 5, showing the water in a second operative condition.

Turning now to FIGS. 5 and 6, the water craft 10 is configured to be operative in both buoyant and submersed modes.

FIG. 5 shows the craft 10 in a typical buoyant state, similar to that of a conventional boat or jet-ski. In this state, the inflatable chambers 22 are shown fully inflated so as to substantially fill their respective cavities 18, and thereby displace any water from the cavities 18. With the chambers 22 inflated in this manner, the platform 20 can be maintained above the water level indicated at 30 due to the positive buoyancy provided by the inflated chambers 22. The water craft 10 can then be manoeuvred in the manner of a conventional jet-ski or boat at the surface of the water, in particular to plane along the water surface.

It should be noted that each cavity 18 defines a nose portion at the front end of the craft 10. The nose portions are rigid and completely encase the respective end of the chambers 22, to protect the front end of the chambers 22 from direct contact with the water as the craft 10 is powered along a water surface. Hence, water is not able to enter the cavities 18 via the nose portions.

If it is desired to submerge or partially submerge the water craft 10, the chambers 22 can be deflated accordingly. As the chambers deflate 22, a void is created between the internal walls of the cavity 18 and its respective chamber 22. Water is then able to enter the craft 10 via the open end of the hull 12. The cavities 18 are open along a significant proportion of their length, at least within the hull 12, to facilitate free flooding of the craft 10 as the chambers 22 deflate. As more air is expelled from the chambers 22, the hull 12 begins to flood and water is able to enter the cavities 18 via the open section along the length of each cavity 18, as well as through the rear end of each cavity 18.

Effectively, the chambers 22 are deflated so as to allow water to flood the hull 12, which then causes the craft 10 to sink. By controlling the rate of deflation, the craft 10 can be caused to sink in a controlled manner relative to the water level 30.

It should be noted that the deflation of the chambers 22 can be controlled to ensure that the craft sinks in a generally horizontal orientation, if desired. This can be achieved by using a series of spaced deflation/inflation ports along the length of each chamber 22, for example. A plurality of separate chambers may also be provided in each cavity, whereby each chamber can be deflated or inflated independently, as required. As such, the control valve arrangement can be configured to monitor the orientation of the craft 10 in the water, and to change the state or rate of deflation across different regions of the craft, so as to vary the buoyancy between the front and rear of the hull 12, for example. Such techniques can be utilised to prevent the craft upending when descending, and to provide a substantially horizontal descent, if desired.

FIG. 6 shows the water craft 10 in a partially submerged state, wherein the inflatable chambers 22 have been partially deflated so that water is able to occupy the remaining capacity of the cavities 18. The craft 10 can then be operated in a partially sub-marine manner.

If the craft 10 is intended to be operated below the water level 30, the or each user will ideally be equipped with diving or scuba equipment, and the chambers 22 can be substantially or completely deflated, as required, to remove positive buoyancy and fully submerge the craft 10.

If it is desired to return the water craft 10 from the partially submerged state shown in FIG. 6 to the normal buoyant state shown in FIG. 5, the chambers 22 are inflated accordingly. As the chambers 22 are inflated they expand, reducing the free space available for water in the hull 12. The expansion of the inflating chambers 22 forces water out of the respective cavities through the open axial regions of the cavities 18, the open end of the cavities, and through the slot-like openings 26.

The expulsion of water from the hull 12 and the increased buoyancy afforded by the inflated chambers 22 causes the craft 10 to raise relative to the water level 30. With the chambers 22 in a fully inflated condition, the overall rigidity of the craft 10 is also increased.

The control valve arrangement can be configured to ensure smooth and controlled raising of the craft 10 to the water surface in a substantially horizontal manner, by controlling the relative buoyancy between the front and rear of the craft, for example.

A water craft in accordance with the invention may take various forms other than that illustrated in FIGS. 1 to 6, wherein the craft preferably defines a submersible body having at least one floodable cavity, and at least one inflatable chamber arranged to displace water from the or each cavity for increasing the buoyancy of the craft. In each embodiment, as the chamber is inflated, it expands to reduce the free space available for water in the cavity, so as to directly expel water from the cavity.

The invention may take the form of a catamaran type craft having a pair of spaced and parallel open hull members, each defining a cavity, and wherein an inflatable chamber is arranged in each chamber for displacing water therefrom, substantially in the manner described above.

The craft may take the form of a single body defining a single cavity having at least one inflatable chamber, wherein the or each chamber is used to maintain the normal buoyancy of the craft, for example with the body in a partially submerged state in the manner of a conventional boat or the like.

In a further embodiment, the invention consists of a submersible tank or hull structure for one or more persons, in which the tank defines a cavity having at least one inflatable chamber for expelling water from the cavity. The tank is intended to move vertically between a normal buoyant position at the surface of the sea or the like and a fully submerged position beneath said surface, and may include thrust means for assisting with the vertical movement.

The craft according to the invention can be in the form of a driver propulsion vehicle (DPV), similar to a self propelled underwater camera, which is intended to be held by a user and which is configured to pull a diver along under water, or in a buoyant state at water level.

The craft can also be in the form of a larger passenger unit, adapted to carry two or more users, either seated or standing.

Figure 7:
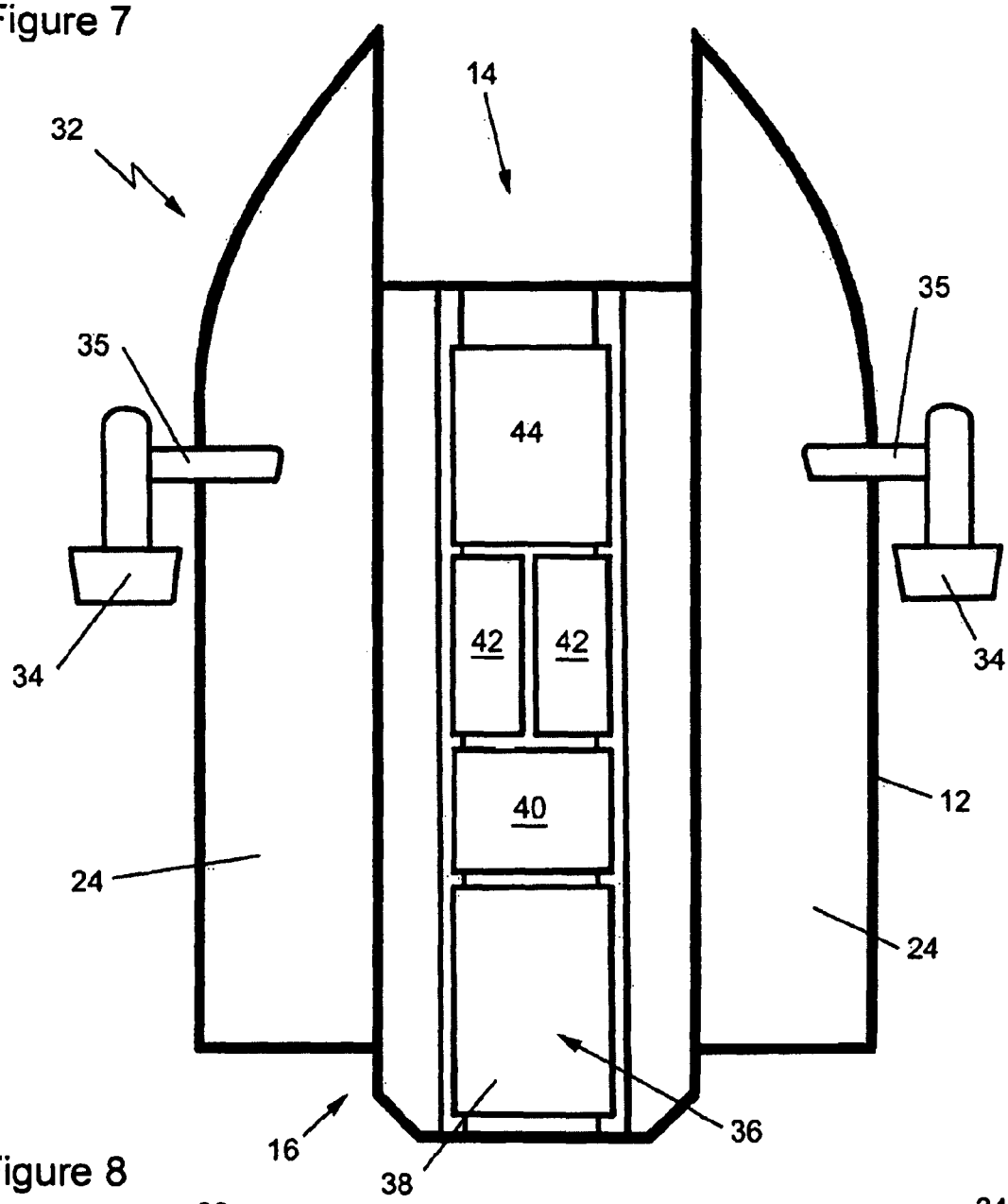
FIG. 7 is a schematic view plan view of a water craft according to a second preferred embodiment of the invention.
Figure 8:
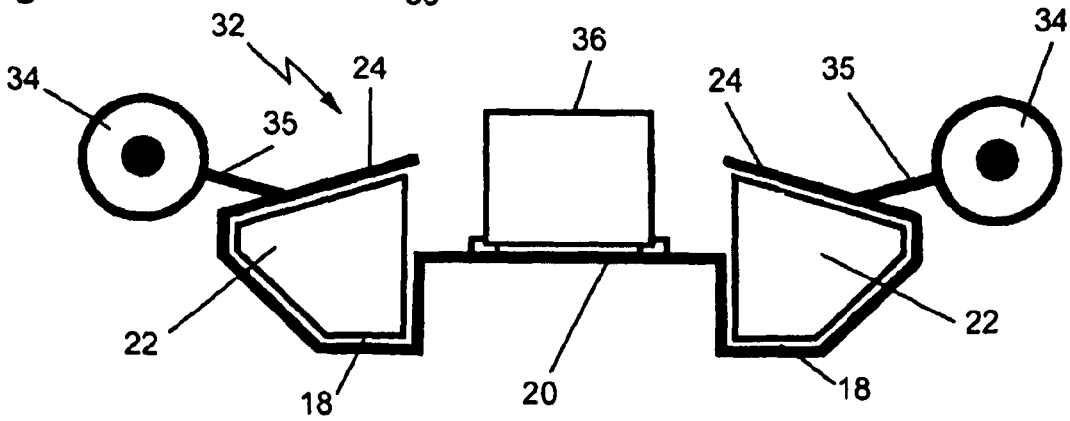
FIG. 8 is a view from the open rear end of the craft shown in FIG. 7.

FIGS. 7 and 8 show a jet-ski type embodiment of the invention indicated generally at 32. The water craft 32 is substantially the same as the craft illustrated in FIGS. 1 to 6, but in this embodiment is adapted for carrying three seated passengers. Where appropriate, the same reference numerals have been used to identify aspects of the water craft 32 which correspond to the same or similar aspects of the water craft 10 from FIGS. 1 to 6.

As can be seen, in this embodiment, the water craft 32 includes two thrusters 34 mounted on arms 35 extending from the upper wall 24 of each cavity 18, for propelling the craft in fully submerged, partially submerged and/or normally buoyant modes. Such thrusters can also be used on the embodiment of FIGS. 1 to 6, for propelling the craft underwater.

A box-section 36 is mounted on the platform 20. Passengers are intended to sit astride the box section 36, which houses an engine 38, fuel tank 40, batteries 42 and an air tank and control arrangement 44 for the chambers 22. Manual control and steering means have been omitted for illustrative purposes, but are mounted towards the front end 14 of the hull 12.

Operation of the craft 32 will be readily apparent to the skilled addressee and corresponds substantially to the operation of the craft 10 referred to above.

Other suitable propulsion systems for planing and under water propulsion will be readily apparent to the skilled reader and are within the contemplation of the invention.

The above described embodiments are advantageous in that they provide free flooding crafts when the chambers are deflating or deflated, that is to say the flood capacity of the craft increases as the inflatable chambers are deflated.

The provision of an open ended cavity or craft of the kind illustrated in the Figures is of particular advantage in enabling responsive submersion of the craft, when desired. The inflatable chambers are preferably received in guides or cavities, which are preferably open along at least a substantial portion of their length, so as to increase the floodability of the cavities, and hence the ability of the craft to submerge quickly, when the chambers are deflated or deflating.

The cavities preferably form an integral part of the body of the craft, for example in the manner of the hull like body shown in FIG. 1.

The crafts are preferably configured to be free-sinking, that is to say they do not have significant positive buoyancy when the or each chamber is deflated. This reduces the amount of thrust required to drive the crafts in a submersible mode, and also enables the crafts to stay submerged. If such a preferred craft is intended for use when diving, the craft can be left on the sea bed or tethered to a wreck or the like, and will not attempt to up end or return to the surface, without the aid of external force. However, the chambers can be used to maintain neutral buoyancy.

The absence of significant positive buoyancy also enables the craft to be readily manoeuvred under water, which is of particular advantage for travelling around reefs or the like.

However, a small sealed chamber suitable for storing personal items or objects to be recovered from underwater may be incorporated.

The configuration and internal pressure of the chambers, once fully inflated, is preferably arranged to increase the structural rigidity of the craft, so as to be more rigid when intended for movement at the water surface. In particular, the fully inflated profile of the inflatable chamber is preferably arranged to correspond substantially with the internal profile of the cavity in which it is inflatably mounted. This reduces the structural reinforcement that might otherwise be required, thereby reducing the overall weight of the craft, particularly in its submersible state. This also increases the capacity for underwater manoeuvre.

The scope of the invention is defined by the claims and includes known and foreseeable equivalents at the date of filing of this application. However, the applicant hereby reserves the right to pursue other aspects of the invention set forth in the statements of invention and the description. The description also incorporates known and foreseeable equivalents at the date of filing of this application.

The invention claimed is:

1. A submersible water craft comprising a stream lined hull by means of which the craft can plane on water, the hull having a front end and a rear end, wherein the rear end of the hull is open so that water can enter the hull via the rear end, and wherein the hull defines opposing flood cavities, each cavity defining an open channel and including an inflatable chamber, the open channel of each cavity extending substantially along an axial length of the cavity, such that the water craft is operable in a submersible mode in which the inflatable chambers are deflated to enable water to flood the cavities to assist in submerging the craft, and wherein the inflatable chambers can be inflated to displace water from the cavities through the open channels for returning the craft to a substantially buoyant mode from said submersible mode.

2. A water craft according to claim 1, wherein each cavity has an open end arranged towards the rear of the craft for enabling water to enter the cavity when the chamber is deflated.

3. A water craft according to claim 1, wherein each cavity defines an open channel extending in the longitudinal axis of the craft, for enabling water to enter the cavity when the chamber is deflated.

4. A water craft according to claim 1, wherein the hull comprises a pair of opposing channels, each including an inflatable chamber, and wherein the channels are arranged to flood, in use, when the chambers are deflated.

5. A water craft according to claim 4, wherein the hull comprises a platform arranged between said channels for receiving one or more passengers.

6. A water craft according to claim 1, wherein each inflatable chamber is configured to fill the cavity in an inflated state, so as to expel substantially all water from the cavity.

7. A water craft according to claim 6, wherein the inflated profile of each chamber is arranged to substantially fill the internal profile of the respective cavity, for providing structural rigidity to the craft.

8. A water craft according to claim 1, wherein the craft has means for controlling the pressure within the or each chamber, and for inflating or deflating said chamber(s) as required.

9. A water craft according to claim 1, wherein the hull is configured for planing along a water surface in a buoyant mode, and wherein the craft includes means for propelling the craft in said buoyant or submersible modes.

10. The water craft according to claim 1, wherein the walls of the cavities form part of the planing structure of the hull.

11. The water craft according to claim 10, wherein the cavities each have an open end that forms part of the open rear end of the hull.

12. A water craft of claim 1, wherein the hull includes opposing flood cavities having opposing open channels.

13. A submersible water craft comprising a stream lined hull by means of which the craft can plane on water, the hull having a front end and a rear end, wherein the hull defines opposing flood cavities, each cavity including an inflatable chamber, such that the water craft is operable in a submersible mode in which the inflatable chambers are deflated to enable water to flood the cavities to assist in submerging the craft, and wherein the inflatable chambers can be inflated to displace water from the cavities for returning the craft to a substantially buoyant mode from said submersible mode, and wherein each cavity extends in an axial direction between the front and rear end of the hull and is open-sided for at least a portion of its axial length, such that water may flow into or be displaced out each cavity through the open-sided portion of the cavity.

14. A water craft of claim 13, wherein the hull includes opposing flood cavities having opposing open-sided portions.

15. A submersible water craft comprising a stream lined hull by means of which the craft can plane on water, the hull having a front end and a rear end, wherein the rear end of the hull is open so that water can enter the hull via the rear end, and wherein the hull defines opposing flood cavities, each cavity defining an open channel of C-shape extending in the longitudinal axis of the craft, and each cavity including an inflatable chamber, such that the water craft is operable in a submersible mode in which the inflatable chambers are deflated to enable water to flood the cavities to assist in submerging the craft, and wherein the inflatable chambers can be inflated to displace water from the cavities for returning the craft to a substantially buoyant mode from said submersible mode.

16. The water craft according to claim 15, wherein the hull defines a platform between said channels for receiving at least one passenger.

17. A submersible water craft comprising:

a hull including a platform and at least two flood frames, the hull being streamlined to enable the craft to plane along a water surface when at speed, and the platform having a top, a bottom, a front, a rear, and a pair of sides, the top of the platform being dimensioned to receive at least one passenger, with a flood frame being positioned on each side of the platform, each flood frame including an upper wall, a side wall and an interior wall, and the walls of each frame defining an interior cavity that is open at a rear of each frame and at least one wall of each frame defining a flood opening, the flood opening extending substantially along the length of the flood frame and being open to the interior cavity so that the flood opening and the open rear of each frame operate to permit the free flow of water into and out of the interior cavity;

a source of pressurized fluid positioned on the hull;

at least one inflatable chamber mounted within the interior cavity of each flood frame, each chamber being in fluid communication with the source of pressurized fluid; and at least one control valve operable to adjust fluid flow between the source of pressurized fluid and the inflatable chambers to selectively inflate or deflate each chamber and thereby selectively configure the craft for planning along the water surface or for submersion below the water surface.

18. A water craft of claim 17, wherein the flood frames of the hull include opposing flood openings.

* * * * *